United States Patent [19]

Jakimowicz et al.

[11] 3,945,308

[45] Mar. 23, 1976

[54] LIMITING CONTROL ARRANGEMENT FOR EXHAUST SYSTEM OPERATION

[75] Inventors: Christopher Jakimowicz, Detroit; Thomas G. Duford, Trenton, both of Mich.

[73] Assignee: National Steel Corporation, Pittsburgh, Pa.

[22] Filed: July 26, 1974

[21] Appl. No.: 492,323

[52] U.S. Cl. ..... 98/115 R; 202/263; 417/280

[51] Int. Cl.[2] ..... F23J 11/00

[58] Field of Search ..... 98/115 R; 417/280; 110/119, 162, 3; 137/486, 487, 487.5; 202/262, 263

[56] References Cited

UNITED STATES PATENTS

| | | | |
|---|---|---|---|
| 1,783,036 | 11/1930 | Crawford | 417/280 |
| 2,418,835 | 4/1947 | Haugsted | 417/280 |
| 2,982,467 | 5/1961 | Corson et al. | 417/280 |
| 3,843,459 | 10/1974 | Krenke | 202/263 |
| 3,844,900 | 10/1974 | Schulte | 202/262 |

*Primary Examiner*—William F. O'Dea
*Assistant Examiner*—Ronald C. Capossela
*Attorney, Agent, or Firm*—Shanley, O'Neil and Baker

[57] ABSTRACT

In an exhaust system for removing smoke and pollutant fumes from the area surrounding the discharge of coke from a coke oven in which air, solids, and gaseous pollutants are moved through an exhaust manifold gated at its inlets, through treating apparatus for removing contaminants from the air, with the cleaned air subsequently discharged to the atmosphere, a method and means are provided for maintaining continuous induced draft within the exhaust system. A means for inducing exhaust flow operates continuously between a minimum flow and maximum capacity depending on whether the inlet gates of the exhaust manifold are closed or open, respectively. A flow control damper located at the suction of the means for inducing exhaust flow is controlled to permit the flow inducing means to operate in accordance with its performance curve up to drawing a predetermined maximum amperage. Upon approaching the predetermined maximum amperage the damper acts to restrict the suction flow and maintain the predetermined maximum amperage.

4 Claims, 1 Drawing Figure

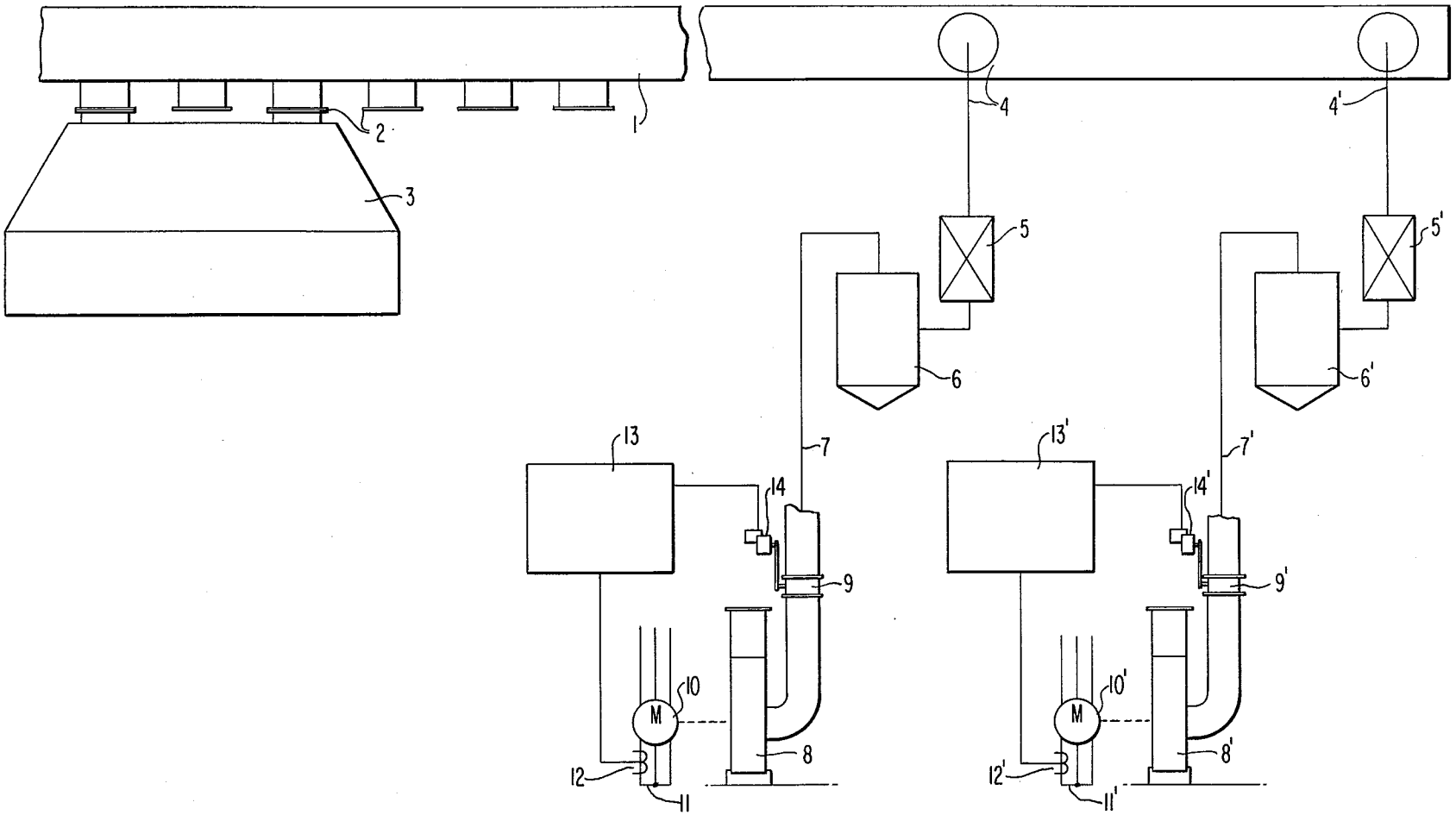
1
2
3
4
4'
5
5'
6
6'
7
7'
8
8'
9
9'
10
10'
11
11'
12
12'
13
13'
14
14'
M
M

LIMITING CONTROL ARRANGEMENT FOR EXHAUST SYSTEM OPERATION

BACKGROUND OF THE INVENTION

Various systems have been proposed for moving the solid and gaseous pollutants produced by the discharge of a coke oven to a location removed from the oven with removal of the contaminants from the air and discharge of the cleaned air back to the atmosphere. Most of these systems entail a means for enshrouding the coke guide carriage and coke transfer car at the discharge of the coke furnace and means with an exhaust manifold through which flow can be induced to a treatment facility. In the treatment facility, the gas flow is contacted with a flow of liquid which wets and removes the solid particles and absorbs the gaseous contaminants. Generally, a flow is induced through the exhaust system by a high capacity exhaust fan or blower and the exhaust manifold is operated with gated openings above the enshrouded areas to allow flow only from the area in which coke is being discharged. In these systems a method for protecting an individual blower drive from running continuously above its safe upper limit is an important desideratum.

Interlocking control systems have been devised for such exhaust arrangements in which an exhaust blower is activated at the time the oven is discharged and an inlet gate or gates in the exhaust manifold opened to permit transfer of pollutants generated during the discharge. Such a control system has the inherent disadvantage of requiring a time delay before exhaust draft is produced throughout the exhaust system. This delay precludes being able to discharge a coke oven at the time the exhaust blower is activated without excessive loss of pollutants to the atmosphere at the oven.

We have devised an exhaust system in which continuous suction or draft is provided within the exhaust manifold. This continuous draft allows simultaneous opening of specified inlet gates in the exhaust manifold and beginning of discharge of a coke oven served by the specified inlet gates with no time delay on application of the exhaust draft.

Referring now to the drawing which schematically represents an exhaust system suited to the limited control arrangement of this invention, an exhaust manifold 1 containing a multiplicity of gated inlets 2 with a canopy 3 enshrouding a coke oven discharge area are shown. The exhaust duct 1 is connected by duct work 4, 4' to a pair of treatment facilities comprising scrubber 5, 5' and separator 6, 6' which are in turn connected by duct work 7, 7' to electrically driven means 8, 8' for inducing exhaust flow.

The exhausting means are usually duplicate high capacity fans or blowers which discharge to the atmosphere.

Looking at one side of the parallel systems, damper 9 is located in the duct work 7 at the suction of the blower 8. The motor or drive means 10 for the blower has associated with its inlet wiring 11 a current transformer 12 for measuring the amperage drawn by the blower motor during operation of the blower. The amperage is measured continuously during operation. A signal is produced and transmitted to means 13 in which it is translated into corresponding power output for actuating control mechanism 14 which positions damper 9. Damper 9 can be a single or multiple vane volume gas flow regulating device. When the blower is operating under conditions in which the exhaust system is closed-in, i.e., the inlet gates 2 are closed and the only inlet flow is leakage around the gates of the multiplicity of gas manifold inlets and other system leakage, the damper opens to a position that permits the fan to achieve a predetermined loaded condition and consequently the fan driver draws a predetermined current. Under such operating conditions the blower will pull a substantially constant draft and the blower motor will draw a substantially constant amperage.

Upon the opening of the inlet gates 2 specified for exhausting the discharge gases of a coke oven, the gas flow within the exhaust system increases even though damper 9 has not changed its position. The increase in flow requires a greater flow of current to the blower motor 10. As the increase in current flow is sensed by current transformer 12 a signal corresponding to the current flow is produced and transmitted through means 13 to actuate the damper controller 14. In response to the signal, damper 9 is partially closed thereby prohibiting the fan from being excessively loaded which would have, in turn, required a greater flow of current to the blower drive. In other words, the flow inducing apparatus is allowed to follow its performance curve using increased current to move an increased volume of flow. This operation continues until a predetermined maximum amperage is reached at which time the maximum permissible flow of gases can take place.

In an operating installation, the exhaust blower can be sized so that when the maximum volume that the exhaust system is designed to handle is being processed, blower motor 10 does not require a current flow greater than the maximum amperage. On the other hand, a duct system is usually designed so that it will handle greater gas flow than the blower can handle without exceeding the maximum current rate for the blower. Further it can be seen that in an exhaust system such as the one illustrated in the drawing in which two exhaust blowers divide the work of accommodating the total volume handled in the exhaust system, a misfunction in one of the systems, such as improper operation of a damper vane, could cause an excess flow to be moved by the blower in the properly performing system. It is also possible that under other circumstances, the current in one or both motors could rise above the maximum set amperage.

In any event, upon sensing a current flow approaching the predetermined maximum, the controlled action of the damper 9 is reversed causing the damper to move toward closed position thereby restricting the blower suction volume so that the rate of increase in current flow required by the blower motor is reduced. If the amperage to motor 10 continues to increase despite the movement of damper 9 toward closing, the closing of the damper continues until the amperage requirement of the drive is stabilized at the predetermined maximum. This mode of operation permits continuous draft to be applied to a large capacity exhaust system or to a parallel exhaust system without danger of overloading a blower motor.

In essense, the exhaust flow inducing means is allowed to operate in accordance with its performance curve with the suction volume of the flow inducing means controlled in direct relation to the indicated amperage requirement of the electric drive within a range limited at the upper end by a predetermined maximum amperage requirement of its electrical drive.

This upper limit is set at an amperage such that continuous operation at the upper limit will not harm the exhaust means or its drive.

As an illustration of the operation of an exhaust system according to this invention a system with two exhaust blowers 8, 8', as shown in the drawing, is operated with the blower motors 10, 10' designed to operate safely at a horsepower requiring a current flow of 54 amperes maximum. The system is designed so that with the gates required to exhaust pollutants during the discharge of a coke oven fully open, the maximum volume required to be moved by each of the two system blowers requires less than 54 amperes maximum current flow to drive each of the blowers. The system is also designed so that with the exhaust gates all closed and the control damper 9, 9' of each blower set partially open, the total flow, equally divided between the two blowers should not cause either blower to draw more than the maximum predetermined amperage nor operate on the instability portion of their performance curve.

Upon opening the gates 2 associated with the discharge of a particular oven each of the blowers is allowed by its control damper to move an increasing volume of gas up to the point that the damper is fully opened and the flow controlling factor is the capacity of the duct work to pass the flow. Conversely, as the flow through the system is restricted by closing the gates 2 and the amperage requirement of the blower motor drops, the controller returns the suction damper to a larger opened position that would reflect the predetermined maximum amperage of the motor.

On start-up, damper 9 is completely closed until the motor and blower are up to rated speed. At that time, if the gates 2 are closed, damper 9 will open toward the full open position to keep the over-all system at the same over-all static pressure loss. Thus the damper tries to keep the blower loaded with the same mass of air. As gates 2 are opened the system pressure loss is less. Damper 9 moves toward closed position to prevent the blower motor from being overloaded. Another factor influences the operation of this system, namely, the temperature of the gases being exhausted. The damper 9 would open to a greater extent when higher temperature gas, during a coke push, would pass through the fan lessening the load and resulting motor amperage. This feature would permit greater draft at the ventilation hood 3 when collection was most required. Once the pushing sequence was completed, colder air would infiltrate the system, the damper 9 would then begin closing until the preset amperage would be achieved.

In the event the flow between the two systems becomes unbalanced by, for instance, an obstruction developing in the scrubber 5' or separator 6' in one half of the divided system, the blower 8 in the unobstructed system operating along its performance curve will continue to move an increasing volume of air up to the point that it approaches a requirement of the predetermined 54 amperes as sensed on the electrical feed line 11 to the motor 10. A signal corresponding to the sensed amperage is generated and transmitted to means 13. The controller 14 is actuated by the signal to begin closing the damper 9 thereby reducing the flow. The closing of the damper 9 is continued until the current flow to the blower motor 10 reaches the predetermined maximum. Thus the direct relationship control of the damper changes to an inverse relationship control as the amperes approach the predetermined maximum current value. Upon completion of the discharge operation and closing of the gated inlets of the exhaust manifold, the flow is reduced so that the current requirement is reduced below the predetermined maximum and the system reverts to control in the range below the predetermined maximum.

We claim:

1. A system for maintaining a continuous subatmospheric gas pressure in a gas exhaust system comprising a. a canopy for enshrouding a coke oven discharge area, the canopy having portions in communication with the atmosphere, b. an exhaust manifold having a plurality of gated inlets, c. a duct connected at one end to the interior of the exhaust manifold, d. blower means connected to the interior of the duct at a point spaced from the exhaust manifold for applying subatmospheric gas pressure to the interior of the exhaust manifold through the duct, e. means for periodically selectively connecting one or more gated inlets to the interior of the canopy to place the interior of the exhaust manifold in gaseous communication with the interior of the canopy to thereby cause a draft to flow through the canopy from the atmosphere, through the exhaust manifold, through the duct and through the blower, there being no opening in the duct nor the exhaust manifold other than the connected gated inlet or inlets, f. electric motor means connected to the blower means for driving the blower means, g. valve means in the duct for controlling the flow of gases through the duct to the blower means, h. control means for actuating valve means (g), i. means for continuously measuring the amplitude of the current drawn by the electric motor means and producing a signal proportional to the amplitude of the current drawn by the electric motor means, j. means for translating the signal produced by means (i) into a power output for actuating control means (h), and k. means associated with the means (j) for varying the power output to actuate means (h) and thereby valve means (g) to control the flow of gases in direct relation to signals corresponding to amplitude of current within a predetermined range of indicated current amplitude and responding to signals indicating an approach to predetermined maximum current amplitude by controlling the flow of gases in inverse relationship to prevent the current from exceeding the predetermined maximum current amplitude.

2. The system of claim 1 in which each of the means (c), (d), (e), (f), (g), (h), (i), (j) and (k) of claim 1 is duplicated to form a parallel path for applying subatmospheric gas pressure to the interior of the exhaust manifold.

3. A method for maintaining a continuous draft in an exhaust system comprising an exhaust manifold with a multiplicity of gated inlets connected to an electrically driven means for inducing an exhaust draft within the manifold, the method comprising:

a. continuously operating the means for inducing an exhaust draft within the manifold, b. continuously measuring the current amperage drawn by the electrical drive of the draft inducing means, c. producing a signal corresponding to the current amperage drawn by the electrical driven means, d. transmitting the signal to a means for controlling the suction flow to the draft inducing means, e. controlling the suction flow to vary in direct relationship to the variation of the current amperage drawn by the electrical drive within a range below a predetermined maximum amperage thereby allowing the draft inducing means to operate in accordance with its performance curve, and f. controlling the suction flow upon the current amperage approaching the predetermined maximum amperage in inverse relationship to prevent the current amperage from exceeding predetermined maximum amperage.

4. The method of claim 3 in which the means for inducing the exhaust draft comprise a plurality of parallel paths and steps (a), (b), (c), (d), (e) and (f) are carried out in the plurality of paths.

* * * * *